United States Patent [19]

Murphy

[11] Patent Number: 4,510,721

[45] Date of Patent: Apr. 16, 1985

[54] FENCE DROPPER

[76] Inventor: Michael F. Murphy, 12 Bond St., Norwood, State of South Australia, Australia

[21] Appl. No.: 467,929

[22] Filed: Feb. 18, 1983

[30] Foreign Application Priority Data

Feb. 19, 1982 [AU] Australia ..... PF2785

[51] Int. Cl.[3] ..... E04H 12/00

[52] U.S. Cl. ..... 52/40; 256/53; 248/74.5

[58] Field of Search ..... 256/32, 46, 53, 54; 248/72, 74.5; 52/40

[56] References Cited

U.S. PATENT DOCUMENTS

| | | | |
|---|---|---|---|
| D. 26,990 | 4/1897 | Howard | 256/53 |
| 504,059 | 8/1893 | Blackburn | 256/54 |
| 580,847 | 4/1897 | Clark | 256/53 |
| 589,898 | 9/1897 | Johnston | 256/53 |
| 814,092 | 3/1906 | Staples | 248/72 |
| 950,978 | 3/1910 | Williams | 248/72 |
| 1,028,630 | 6/1912 | Stryker | 256/53 |
| 1,809,055 | 6/1931 | McKee | 248/65 |
| 4,157,800 | 6/1979 | Senter | 248/74.7 |

FOREIGN PATENT DOCUMENTS

| | | | |
|---|---|---|---|
| 472523 | 3/1951 | Canada | 248/72 |
| 57107 | 1/1940 | Denmark | 47/47 |
| 2164991 | 7/1973 | Fed. Rep. of Germany | 248/72 |

*Primary Examiner*—Henry E. Raduazo

*Attorney, Agent, or Firm*—Jay L. Chaskin

[57] ABSTRACT

A post or dropper is formed from a strip of sheet metal to have a pair of webs in a "V" formation terminating in parallel flanges, there being at least one pair of apertures in the side walls, at least one wire retainer loop of general "U" shape having inturned ends which engage the apertures, and at least one pair of notches in the parallel flanges which retain a fence wire to the post.

6 Claims, 4 Drawing Figures

FENCE DROPPER

This invention relates to a fence dropper (fence post) which is particularly suitable for supporting trellis wires for a vineyard, although as will be seen, the invention is also applicable for general purposes.

BACKGROUND OF THE INVENTION

One of the problems which is encountered with fence posts or droppers of the notched edge type is the tendency for a fracture to occur intermediate the ends where they are notched to receive fence wires, and this is of particular importance in those instances wherein the droppers or posts are utilised in vineyards, and are subject to vibration due to the tension of the wires, and when harvesting takes place, flexure due to the action of a mechanical harvester.

One object of this invention is to provide a fence post whereby the notching effect intermediate the ends is limited, and thus the effect causing fracture is reduced.

In a vineyard, sometimes a trellising fence is required to have two fence wires, one of which supports a vine, and the lower one of which supports a tube which carries water for drip irrigation. It is desirable that the tube should be capable of being supported on either one side or the other side of the fence posts, but the tube is formed from a polymeric material which is capable of creep under hot conditions. In order for a fence post to be flexible for use with a mechanical harvester, it is desirable that the configuration should not include outstanding flanges which lie parallel to the plane of the fence wires, but a general "V" shape is found to be more suitable. This however provides raw edges on one side of the post, and these raw edges are likely to abrade or damage the wall of a conduit, and another object of this invention is to provide means whereby a water conduit for a drip irrigation system is less likely to be damaged by the edges of a post at least on that side where the raw edges exist.

BRIEF SUMMARY OF THE INVENTION

In this invention a post or dropper is formed from a strip of sheet metal to have a pair of webs in a "V" formation terminating in parallel flanges, there being at least one pair of apertures in the side walls, at least one wire retainer loop of general "U" shape having inturned ends which engage the apertures, and at least one pair of notches in the parallel flanges which retain a fence wire to the post.

By careful positioning of the apertures, the wire loop can be effective on both sides of the fence post, and by careful shaping of the wire loop, the loop can be made to bear against the raw edges and thus hold the dripper tube away from the post avoiding damage to the tube which might otherwise occur.

More specifically, the invention consists of a fence dropper having been formed from a strip of sheet metal to have a pair of webs in a "V" formation, terminating in respective flanges which are substantially parallel to each other, at least one pair of aligned apertures in said parallel flanges, at least one wire retaining loop of such shape as to support a conduit, and having inturned ends engaging said pair of aligned apertures, and notch defining surfaces also in said parallel flanges defining at least one pair of notches extending in to the flanges and of such shape as to retain a fence wire.

DESCRIPTION OF THE DRAWINGS

An embodiment of the invention is described hereunder in some detail with reference to, and is illustrated in, the accompanying drawings, in which.

Figure 1:
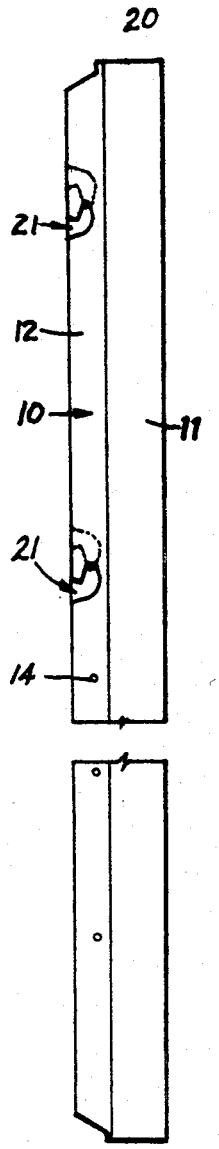
FIG. 1 is an elevation of a fence dropper.

In this embodiment a fence post 10 is formed by a roll forming process, from a strip of flat sheet metal. The fence post is formed to have a pair of webs 11 in a "V" formation terminating in respective flanges 12 which are parallel or nearly parallel and which terminate in curved edges 13. The flanges 12 are provided with a plurality of apertures 14 arranged in pairs, and a wire loop 15, when engaging those apertures, may be effective on either of the sides of the dropper, so that a drip irrigator conduit 16 can be selectively supported on either side of the dropper.

In this embodiment, near its upper end 20, the dropper has its outer flanges 12 notched with two pairs of "L" shaped notches 21, with edges 22 which enter the flanges at different heights, the notch forming surfaces of one of the notches sloping upwardly and the other sloping downwardly, the surfaces 22 of each notch converging towards its inner end 24. The use of pairs of notches is in accordance with known art and provides a very satisfactory retention means for retention of a wire. However, the convergence of the surfaces enhances retention of wires over a wide range of wire diameters. In some instances there are several pairs of notches, and in the embodiment illustrated, there are two pairs.

Figure 2:
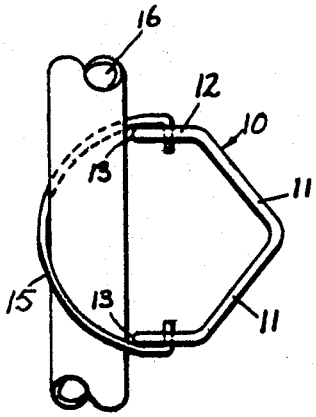
FIG. 2 is a plan, drawn to an enlarged scale, and showing a conduit supported by a wire loop.
Figure 3:
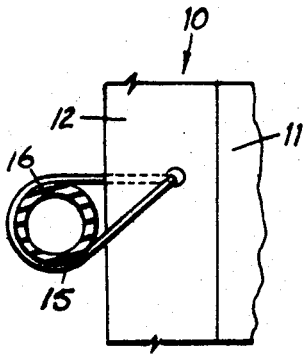
FIG. 3 is a side elevation of FIG. 2.
Figure 4:
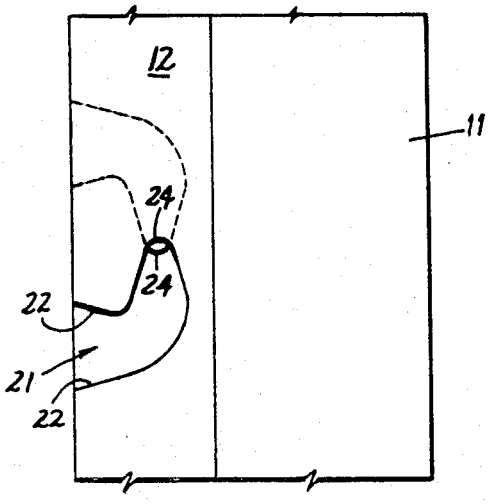
FIG. 4 is an enlarged elevation showing the shape of the notch defining surfaces.

The wire loop 15 is formed to general "U" shape in plan (FIG. 2), a general "S" shape in front elevation and a general tear drop shape in side elevation (FIG. 3), and is of such dimension that the conduit, a conduit support wire, or both, for drip irrigation can be supported by passing through the loop which appears in end elevation. The ends 26 of the wire loop 15 are inturned and engage a pair of apertures 14 which extend through the flanges of the post (dropper). The wire is a spring steel wire and is easily located by simply snapping the inturned ends into the outer sides. The apertures need to be only very small in diameter to accommodate the light spring wire clip, and thus it will be seen that towards the centre of the post there is no notch entering the post from its extreme edge, and thus the notching effect which has been largely responsible for the development of fatigue cracks in other droppers is avoided in this invention. The locations of the ridges are so arranged that the wire loop will retain a conduit for drip irrigation contiguous with the curved surface at the apex of the "V" shaped web, that the lower legs of respective said wires will engage the edges of the flanges when the conduit is otherwise likely to bear against the raw edges, the shape and size of each wire loop 15 being such that the loop will then hold the conduit clear of those raw edges.

Various modifications in structure and/or function may be made by one skilled in the art without departing from the scope of the invention as defined by the claims.

What is claimed is:

1. A fence droper having been formed from a strip of sheet metal to have a pair of webs in a "V" formation, terminating in respective flanges which are substantially parallel to each other, at least one pair of aligned apertures in said parallel flanges;

at least one wire retaining loop of such shape as to support a conduit, and having inturned ends engaging said pair of aligned apertures, said wire loop comprises a pair of legs and a bridge portion defining a general "U" shaped in plan and a tear drop shape in side elevation, one of said legs bearing against a flange edge when the loop supports a conduit, the shape and size of the wire loop being such that the wire loop thereby holds the conduit clear of the flange edges, and notch defining surfaces also in said parallel flanges defining at least one pair of notches extending into the flanges and of such shape as to retain a fence wire.

2. A fence dropper according to claim 1 wherein the notches of each pair are substantially "L" shape and enter the flanges at different heights, the notch-forming surfaces of one of the notches sloping upwardly, and of the other sloping downwardly, said surfaces of each notch converging towards the inner end thereof.

3. A fence dropper according to claim 1 wherein the flange edges are of curved shape in cross section.

4. A fence dropper according to claim 1 wherein the flange ends are of level shape towards the webs.

5. A fence dropper according to claim 2 wherein the flange edges are curved shape in cross section.

6. A fence dropper according to claim 2 wherein the flange ends are bevel towards the web.

* * * * *